United States Patent [19]

Dean, Jr.

[11] 4,335,549

[45] Jun. 22, 1982

[54] METHOD, BUILDING STRUCTURE AND SIDE-SPLIT BLOCK THEREFORE

[75] Inventor: Robert W. Dean, Jr., Milwaukee, Wis.

[73] Assignee: Designer Blocks, Inc., Milwaukee, Wis.

[21] Appl. No.: 211,513

[22] Filed: Dec. 1, 1980

[51] Int. Cl.[3] ..... E04C 1/00; B44F 7/00; B44F 9/04

[52] U.S. Cl. ..... 52/98; 52/314; 52/316; 52/747; D25/86

[58] Field of Search ..... 52/98, 100, 311, 314, 52/316, 747; D25/86, 84

[56] References Cited

U.S. PATENT DOCUMENTS

| | | | |
|---|---|---|---|
| 379,429 | 3/1888 | Werth . | |
| 415,773 | 11/1889 | Fiske | 52/316 |
| 787,199 | 4/1905 | Lloyd | 52/316 X |
| 1,263,194 | 4/1918 | Blake . | |
| 1,323,512 | 12/1919 | Whitacre . | |
| 1,534,353 | 4/1925 | Besser . | |
| 1,872,522 | 8/1932 | Stuckey . | |
| 1,893,430 | 1/1933 | McKenzie . | |
| 2,957,278 | 10/1960 | Woodworth | 52/316 |

FOREIGN PATENT DOCUMENTS

| | | | |
|---|---|---|---|
| 187032 | 10/1956 | Austria | 52/98 |
| 79016 | 5/1950 | Czechoslovakia | 52/98 |
| 11582 | of 1908 | United Kingdom | 52/100 |

OTHER PUBLICATIONS

J3474 V/37b 11-1955, German Printed Patent Application 1 dwg., 2 spec.

Pictorial Concrete Masonry/Office Buildings, vol. 35, No. 7, Jul. 1979, Pub. National Concrete Masonry Assoc., 2302 Horse Pen Road, Herndon, Va. 22070.

Best Block's Ribbed Split, Pub. Best Block Co., Butler, Wisconsin.

Best Block's Fluted Split, Pub. Best Block Co., Butler, Wisconsin.

Best Block's Split Stone, Pub. Best Block Co., Butler, Wisconsin.

Best Block's Best Stone, Pub. Best Block Co., Butler, Wisconsin.

Columbia 4-Way (Inline) Block Splitter Model-S32, Operations and Instructions, Pub. Columbia Machine, Inc. Vancouver, Washington.

National Concrete Masonry Assoc., NCMA-TEK 40, 1972.

NCMA-TEK 42, 1972, Pub. National Concrete Masonry Assoc.

NCMA-TEK 49, 1973, Pub. National Concrete Masonry Assoc.

*Primary Examiner*—Alfred C. Perham

*Attorney, Agent, or Firm*—Andrus, Sceales, Starke and Sawall

[57] ABSTRACT

A composite module (14) is formed by a specially constructed mold (65) and division plate (80) to form plural splitting planes (28, 31, 33, 51, 54, 56) in the composite module which is thereafter split by a series of knives (114-116, 121-123, 126, 127) aligned with such predefined splitting planes to split the module into plural blocks (12, 13) each having plural irregular decorative surface areas (25, 26, 27; 48, 49, 50) having different widths (35, 37, 39; 58, 60, 62) and depths (30, 32, 34; 52, 55, 57). Such split-type decorative areas within a course (131) are aligned out of vertical alignment with decorative areas of other blocks in adjacent courses (130, 132) to form a decorative wall (134).

13 Claims, 12 Drawing Figures

Fig. 5
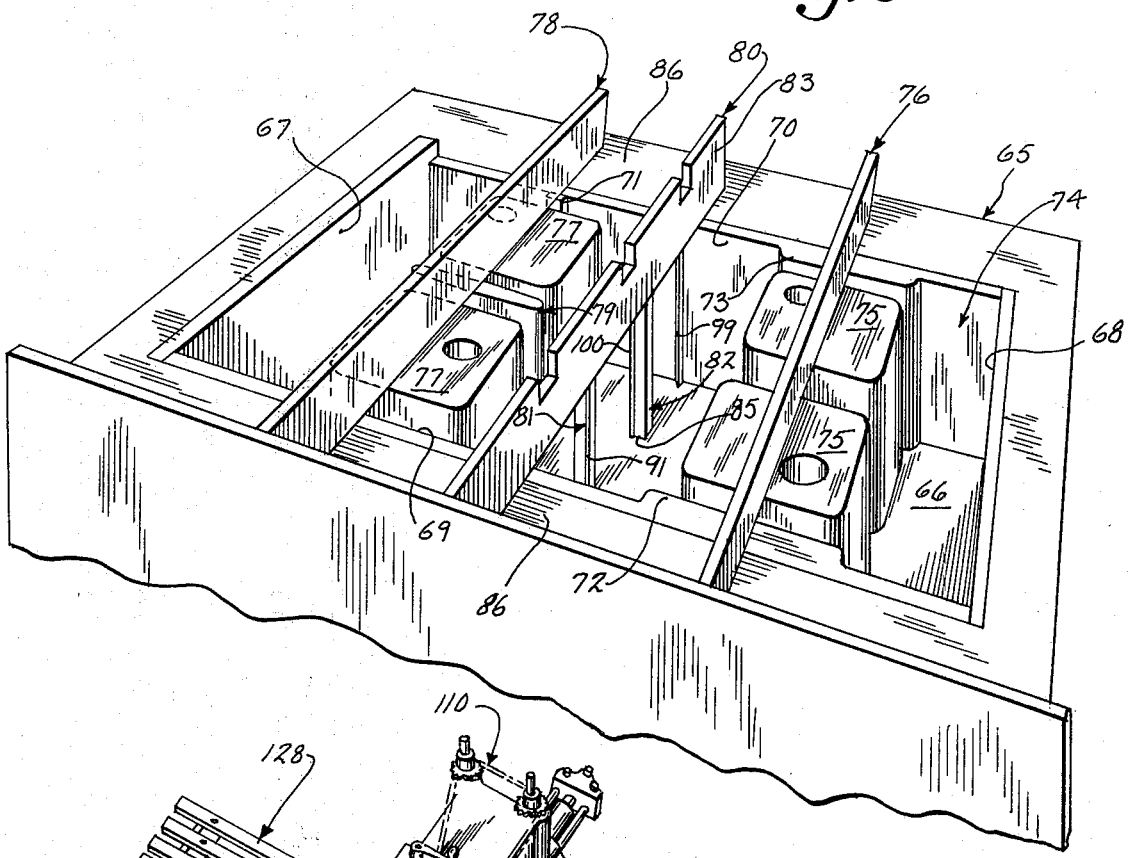
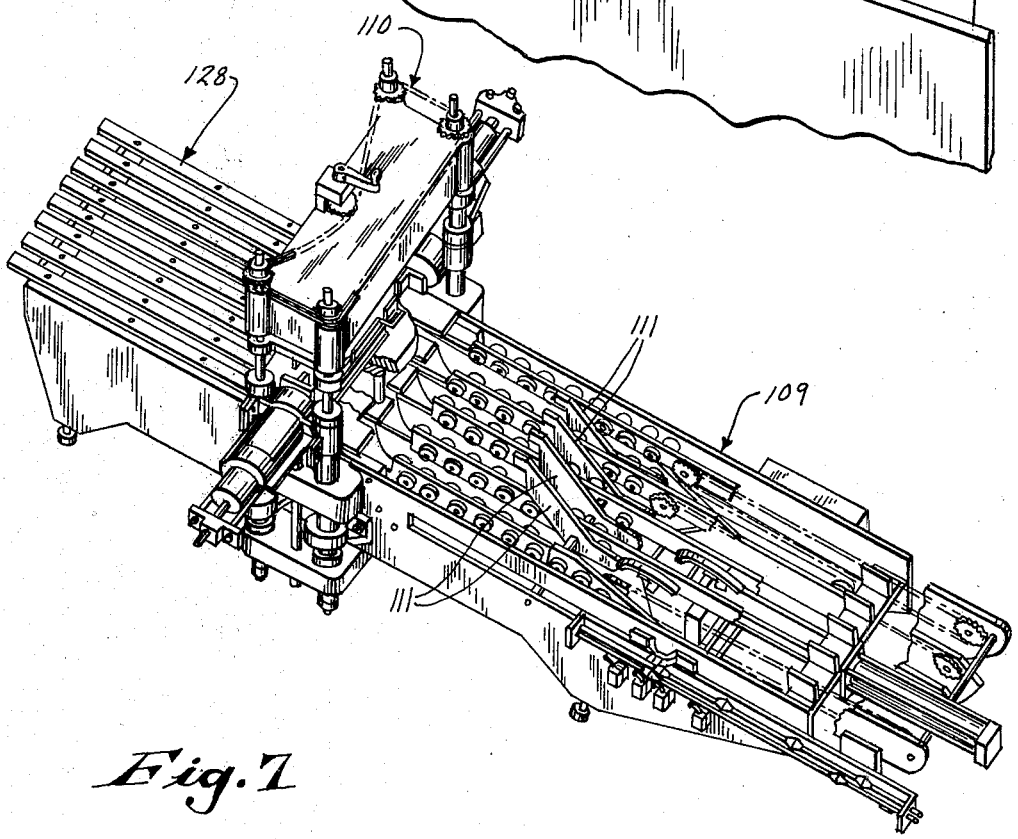
Fig. 7

METHOD, BUILDING STRUCTURE AND SIDE-SPLIT BLOCK THEREFORE

BACKGROUND OF THE INVENTION

The invention relates to a primary masonry type block formed from concrete and a method of manufacture thereof and a masonry wall constructed of a plurality of blocks laid up in courses and a method of constucting the same.

Various building type blocks have been made from cement-like material such as concrete or similar material to be used in constructing walls or the like. Many of such blocks have been constructed for strength and heat insulating purposes. Further, many building type blocks have been irregularly shaped and/or colored to provide a decorative appearance. In some constructions, two or more blocks have been molded as an integral unit and thereafter split to provide an outer surface having a rough irregular type decorative outward appearance.

BRIEF SUMMARY OF THE INVENTION

A primary masonry type block formed from concrete provides a front surface including a first surface area having a distinct irregular split-type decorative appearance which includes a portion space from a reference plane provided by a back wall surface by a first predetermined depth. The front surface further includes a second surface area having a distinct irregular split-type decorative appearance which includes a portion space from the reference plane by a second predetermined depth which is substantially different than the first depth. In such manner, the primary masonry type block provides a plurality of distinct irregular split type surface areas of varying depths for a decorative appearance.

The first front surface area is formed with a first predetermined width while the second surface area is formed with a second predetermined width substantially different than the first width. In such manner, the primary masonry type block provides a front surface having a plurality of distinct irregular split-type surface areas of varying widths for a decorative appearance.

Two building type blocks are simultaneously formed. A mold is formed which provides oppositely spaced first and second back walls and oppositely spaced first and second side walls to provide a cavity therebetween. A projection is placed in the cavity to be spaced from the first and second back walls to define two block shaped compartments and further define first and second substantially parallel splitting planes which intersect the projection and the first and second side walls. A composite module is formed by placing cement-like material into the mold and removing the projection so that the cured material includes two integrally joined blocks. The composite module is split along selected portions of the first and second splitting planes to form the first and second blocks each providing first and second front surface portions of different depths with respect to the corresponding first and second back walls for a decorative appearance.

First and second ridges are formed on the projection so as to be within the first and second splitting planes, respectively. In such manner, the ridges form first and second guides to facilitate the splitting of the composite module. First and second ridges are also placed on the first and second side walls, respectively, to be within the first and second splitting planes, respectively. In such manner, the ridges form first and second guides to facilitate the splitting of the composite module.

The projection is placed in the mold at a first predetermined distance from the first side wall and a second predetermined distance different than the first distance from the second side wall. When the composite module is split, a first front surface portion is provided of a first predetermined width while the second front surface portion is provided with a second predetermined width different from the first width.

A pair of projections or prongs are provided by a division member where the first prong is placed at a first predetermined distance from the side wall of the mold and the second prong is placed at a second predetermined distance from a second oppositely spaced side wall of the mold to divide each compartment into first, second and third sections which are spaced by first, second and third predetermined depths, respectively, from a first back wall and spaced by fourth, fifth and sixth predetermined depths, respectively, from a second back wall oppositely spaced from the first back wall.

The composite module is engaged by first, second, third and fourth pairs of oppositely disposed splitting knives with the first pair of knives engaging one of the openings formed by the division member prongs to form first and fourth front wall split surface portions of the first and second blocks respectively. The second pair of knives engages one of the openings to form second and fifth front wall split surface portions of the first and second blocks respectively. The third pair of knives engages one of the openings to form third and sixth front wall split surface portions of the first and second blocks respectively. The fourth pair of knives engage oppositely spaced side walls of the composite module. One of the fourth knives is aligned with the first knives to assist in forming the first and fourth split surface portions. Another of the fourth knives is aligned with the third knives to assist in forming the third and sixth split surface portions. In such manner, the composite module is split to provide first and second blocks with the first block providing first, second and third split type surface portions of irregular and decorative appearance including first, second and third different depths, respectively, and first, second and third different widths, respectively. The second block, on the other hand, provides fourth, fifth and sixth split type surface portions of irregular and decorative appearance having fourth, fifth and sixth different depths, respectively, and fourth, fifth and sixth widths, respectively.

When using a division member with two prongs, a first ridge is provided on the first prong and is alinged with a second ridge placed on the first side wall to form a first splitting plane. A third ridge is placed on the first prong while a fourth ridge is placed on the second prong to be aligned within a second splitting plane which is spaced from the first splitting plane. A fifth ridge is placed on a second prong and aligned with a sixth ridge placed on a second side wall to be within a third splitting plane which is spaced from the first and second splitting planes.

A masonry wall is constructed of a plurality of blocks laid up in courses with mortared joints therebetween wherein each of the blocks provides a back surface and oppositely spaced front surface. The front surface includes a first surface area having a distinct irregular split type decorative appearance including a portion spaced by a first predetermined depth from a reference plane provided by the back surface and a second surface area having a distinct irregular split type decorative appearance including a portion spaced by a second predetermined depth different from the first depth from the reference plane. First and second surface areas in one course are spaced out of vertical alignment with first and second surface areas in another immediately adjacent course to provide a wall having a plurality of adjacent surface portion areas of randomly different depths for a decorative appearance.

With the front surface of each block including a first surface area having a distinct irregular split type decorative appearance having a first predetermined width and a second surface area having a distinct irregular split type decorative appearance having a second predetermined width different than the first width, the first and second surface areas in one course are spaced out of vertical alignment with the first and second surface areas in another immediately adjacent course to provide a wall having a plurality of adjacent surface portions of randomly different widths for a decorative appearance.

A masonry wall may be formed of a plurality of first and second blocks formed from a single molded construction and laid up in courses with mortared joints therebetween. The first blocks used in such wall include a front wall surface including first, second and third distinct surface areas each at a different depth with respect to the block back surface and each having a different width. The second blocks used in such wall include fourth, fifth and sixth distinct surface areas each spaced from the back wall portion by a different depth and each having a different width. In the wall, the first and sixth surface portions are located immediately adjacent to each other while the third and fourth surface portions are located immediately adjacent to each other within each course. The first through sixth portions in one course are spaced out of vertical alignment with the first through sixth portions in another immediately adjacent course to provide a wall having a plurality of adjacent surface portions of randomly different widths and depths for a decorative appearance.

The blocks and manufacture thereof have been found to provide an extremely decorative appearance particularly when formed in a wall configuration and are economical to manufacture.

BRIEF DESCRIPTION OF THE DRAWINGS

FIG. 5 is a perspective view of a mold containing a division member for making the composite unit of FIG. 3;

FIG. 7 is a perspective view of a block splitting apparatus for splitting the composite unit of FIG. 3;

DESCRIPTION OF THE PREFERRED EMBODIMENT

Figure 1:
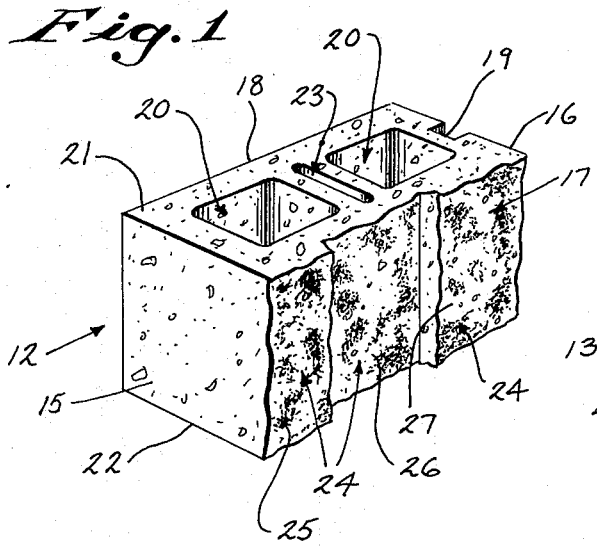
FIG. 1 is a perspective view of a building block formed in accordance with the invention.
Figure 2:
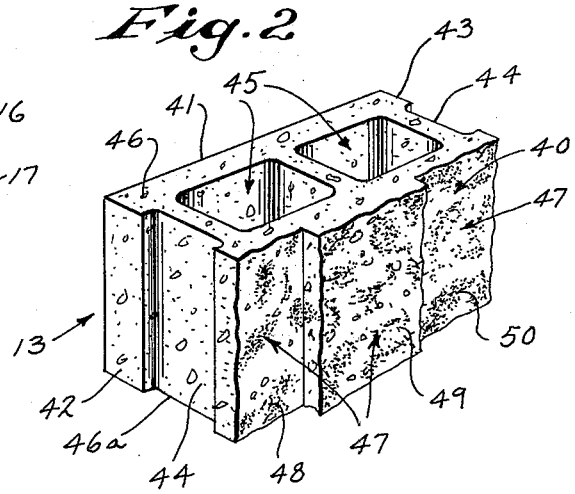
FIG. 2 is a perspective view of another building block formed in accordance with the invention.

A pair of blocks 12 and 13 are formed by splitting a unitary composite module 14 which is formed of cement-like material commonly used in primary masonry type blocks, such as concrete.

The block 12 includes a pair of oppositely spaced sidewalls 15 and 16 and a front wall 17 oppositely spaced from a back wall 18. Any type of surface configuration may be used for the sidewalls 15 and 16 and the back wall 18. In the illustrated embodiment, the sidewalls 15 and 16 and the backwall 18 are formed with a substantially smooth surface with sidewall 16 including a vertical channel 19 which may function as a keyway to retain an expansion seam made of rubber or the like (not shown). The block 12 may have one or more central cores formed in a customary fashion and the illustrated embodiment discloses a pair of cores 20 which pass through the block from a top surface 21 to a bottom surface 22. If desired, a further opening may exist between the top and bottom walls 21 and 22 which may be formed as a long narrow slit 23 which functions to provide a guide for splitting the block during installation such as customarily done when forming a corner or an endwall.

The front wall 17 includes a plurality of surface portions 24 and the illustrated embodiment includes three distinct surface areas 25, 26 and 27 each having a split-type decorative appearance and a different area than adjacent surface areas. When formed, the surface area 25 is split substantially along a plane 28 spaced from a plane 29 including at least a portion of back wall 18 by a first predetermined distance 30. The surface area 27 is formed by splitting along a splitting plane 31 which is spaced from the plane 29 by a predetermined distance 32 which is less than the predetermined distance 30. The surface area 26 is formed by splitting along a splitting plane 33 which is spaced from the plane 29 by a predetermined distance 34 which is less than the predetermined distances 30 and 32.

The split decorative surface 25 has a predetermined width 35 and extends from a point adjacent to the sidewall 15 to a point adjacent to a vertical groove 36 molded into the block as more fully described hereafter. The split decorative surface 26 has a predetermined width 37 which is greater than width 35 and extends from the vertical molded groove 36 to a vertical molded groove 38. The irregular split surface 27 has a predetermined width 39 which is greater than width 35 and less than width 37 and extends from groove 38 to a point adjacent to the sidewall 16.

The block 13 has a front wall surface 40 oppositely spaced from a back wall surface 41 and a pair of oppositely spaced sidewalls 42 and 43 with each of the sidewalls including an associated end channel 44 such as frequently formed in cement blocks. As in block 12, a pair of core openings 45 extend through the block from an upper surface 46 to a lower surface **46*a***.

The front surface 40 of block 13 includes a plurality of surface areas 47 and the illustrated embodiment discloses three such areas at 48, 49 and 50. Each of the surface areas 48–50 are formed by splitting to provide a split-type irregular decorative wall appearance. The surface area 48 is split along a plane 51 which is spaced by a predetermined distance 52 from a plane 53 which includes at least a portion of the back wall surface 41. The surface area 50 is split along a plane 54 which is spaced by a predetermined distance 55 from the plane 53. The surface area 49 is split along a plane 56 which is spaced by a predetermined distance 57 from the plane 53. The predetermined distance 52 is smaller than the distances 55 and 57 while the distance 57 is greater than the distances 52 and 55.

The surface area 48 has a predetermined width 58 which extends from a point adjacent to the sidewall 42 to a molded groove 59. The surface area 49 has a predetermined width 60 which extends from the groove 59 to another molded groove 61. The surface area 50 has a predetermined width 62 which extends from the groove 61 to a point adjacent to the sidewall 43. The width 58 of surface area 48 is substantially less than the widths 60 and 62 while the width 60 of surface area 49 is substantially larger than the widths 58 and 62.

A mold box 65 contains a bottom wall 66 surrounded by a pair of spaced endwalls 67 and 68 and a pair of spaced sidewalls 69 and 70. A vertically extending projection 71 is formed along wall 70 and is designed to mold the channel 19 in block 12. A pair of oppositely spaced, vertically extending portions 72 and 73 likewise project into a central cavity 74 of box 65 from sidewalls 69 and 70, respectively, which are designed to form the end portions 44 of block 13. A pair of rectangularly shaped forms 75 are spaced along a retaining bar 76 and are removably positioned within the mold cavity 74 to form the cavities 45 in block 13. Similarly, a pair of rectangularly shaped mold forms 77 and an intermediate form 79 are spaced along a retaining bar 78 and are removably positioned within the chamber or cavity 74 so as to form the cavities 20 and 23 within the block 12.

A specially constructed division plate 80 includes a pair of spaced prongs 81 and 82 which are retained in fixed relationship to each other by the interconnection through a supporting bar 83. The prongs 81 and 82 are placed into the mold chamber 74 so that the end portions 84 and 85 rest upon the bottom wall 66 of mold chamber 65 while the outer extremities of the connecting bar 83 rest upon the upper portions 86 of mold box 65.

The prongs 81 and 82 are specially constructed and positioned with respect to each other and with respect to the cavity 74 of mold box 65. The prong 81 has a vertical wall 87 which functions to form the vertical groove 59 in block 13 and an oppositely spaced vertical wall 88 which functions to form the vertical groove 38 in block 12. The prong 81 further includes a pair of spaced sidewalls including the wall 89 which faces the mold box wall 69 and an oppositely disposed wall 90 which faces the mold box wall 70. The wall 89 includes a vertically extending lip or ridge 91 which is located adjacent to wall 87 and is located within the planes 28 and 51 for the blocks 12 and 13, respectively. The mold box wall 69 provides a similarly constructed lip or ridge 92 which faces ridge 91 and is likewise located within the planes 28 and 51 for blocks 12 and 13, respectively. The wall 90 of prong 81 includes a vertically extending lip or ridge 93 which is located adjacent to the wall 88 and is located within planes 33 and 56 corresponding to blocks 12 and 13, respectively.

The prong 82 includes a vertically extending wall 94 which functions to provide the vertically extending groove 61 of block 13 and an oppositely spaced vertically extending wall 95 which functions to provide the vertically extending groove 36 in block 12. Prong 82 further provides a pair of oppositely spaced and vertically extending sidewalls 96 and 97 with wall 96 facing the mold box wall 70 while wall 97 faces the mold box wall 69. The wall 96 includes a vertically extending lip or ridge 98 which is located adjacent to wall 94 and lies within the planes 31 and 54 of blocks 12 and 13, respectively. The mold box wall 70 includes a similarly constructed vertically extending lip or ridge 99 which is aligned with ridge 98 so as to be located within the planes 31 and 54 of blocks 12 and 13, respectively. The wall 97 of prong 82 includes a vertically extending lip or ridge 100 which is adjacent to the wall 95 and is aligned with ridge 93 of prong 81 so as to be within the planes 33 and 56 corresponding to blocks 12 and 13, respectively.

The prongs 81 and 82 are placed within mold box 65 so as to be relatively located with respect to endwalls 67 and 68 and sidewalls 69 and 70. Specifically, the ridge 91 is spaced from ridge 92 by a predetermined distance 35, 58. The ridge 93 is spaced from ridge 100 by a predetermined distance 37, 60. The ridge 98 is spaced from the ridge 99 by a predetermined distance 39, 62. Further, the ridges 91 and 92 are spaced from the mold box end-wall 67 by a predetermined distance 30 and also spaced from the mold box endwall 68 by a predetermined distance 52. The ridges 93 and 100 are spaced from the mold box endwall 67 by a predetermined distance 34 and are spaced from the mold box endwall 68 by a predetermined distance 57. The ridges 98 and 99 are spaced from the mold box endwall 67 by a predetermined distance 32 and are spaced from the mold box endwall 68 by a predetermined distance 55.

Figure 3:
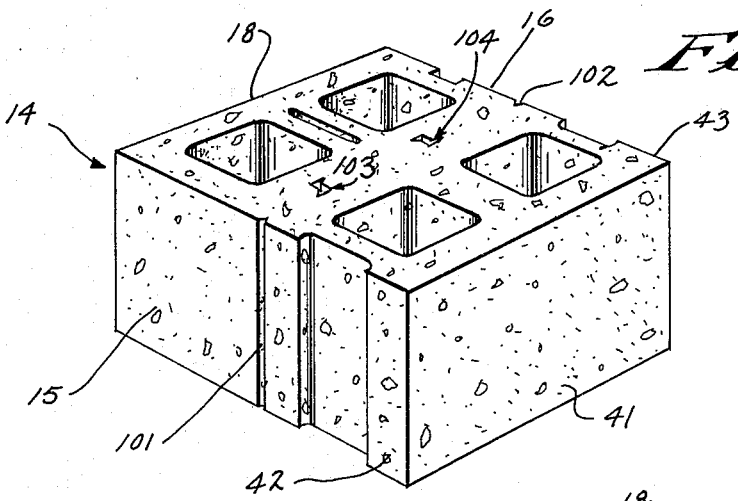
FIG. 3 is a perspective view of a composite unit containing the molded blocks of FIGS. 1 and 2 prior to splitting.
Figure 4:
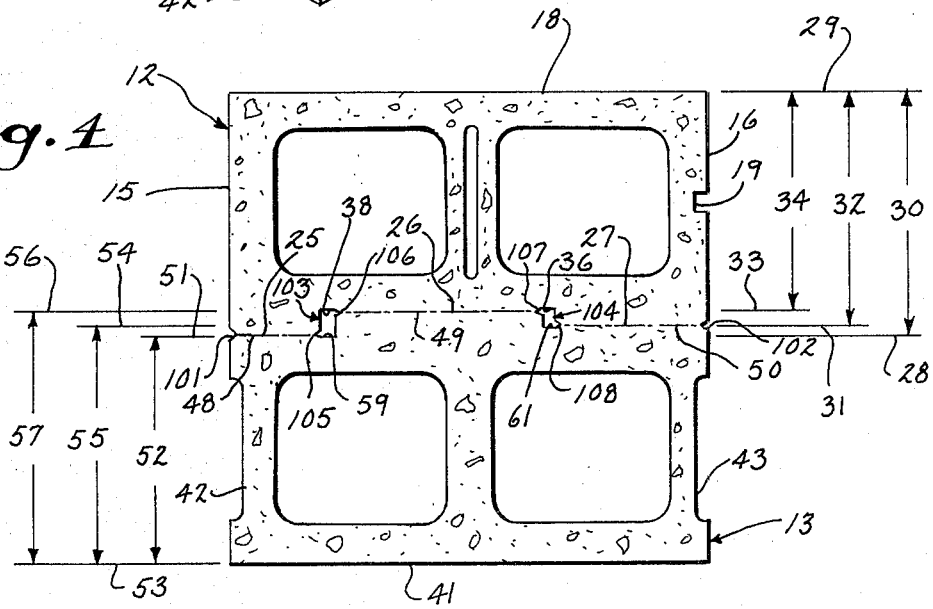
FIG. 4 is a plan view of the composite unit of FIG. 3.
Figure 9:
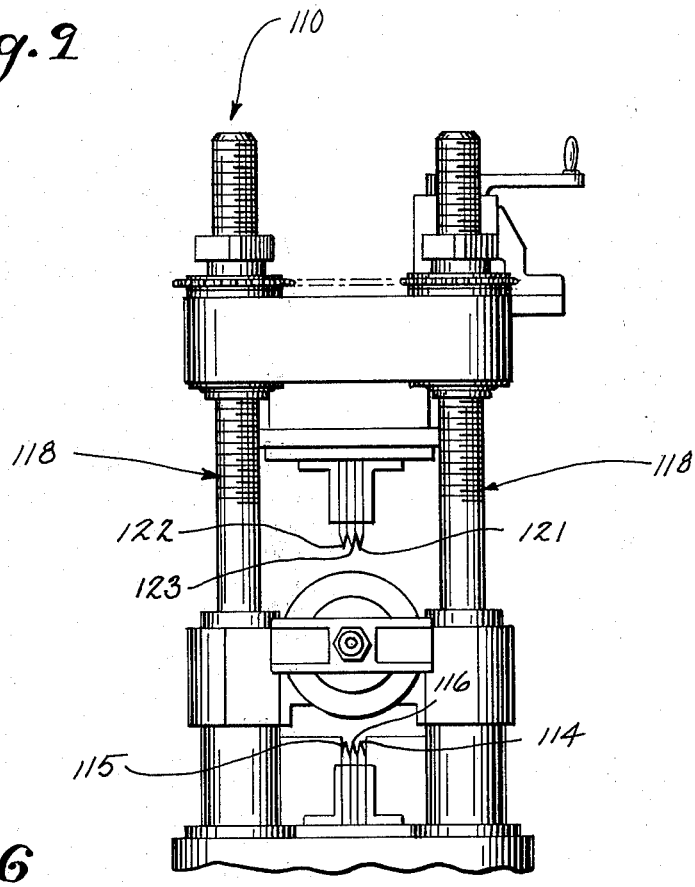
FIG. 9 is a side elevational view of a portion of the splitting apparatus of FIG. 7.
Figure 6:
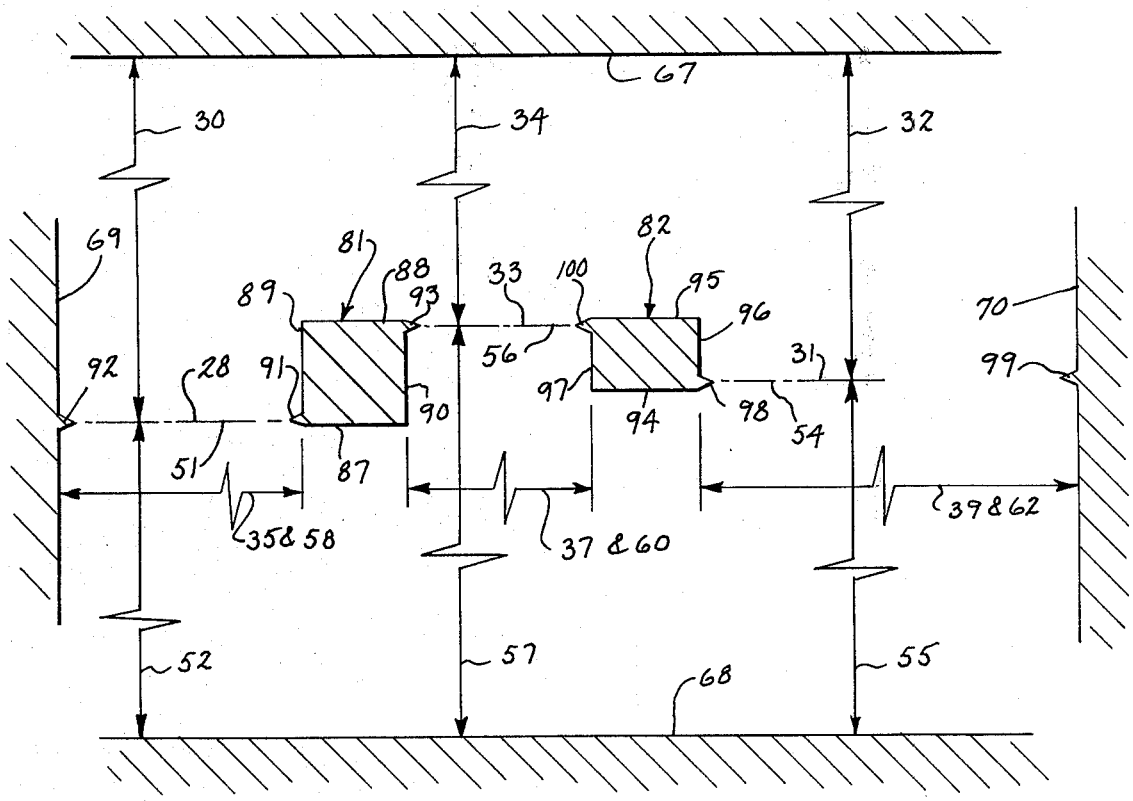
FIG. 6 is a plan illustration of a portion of the mold and division member of FIG. 5
Figure 8:
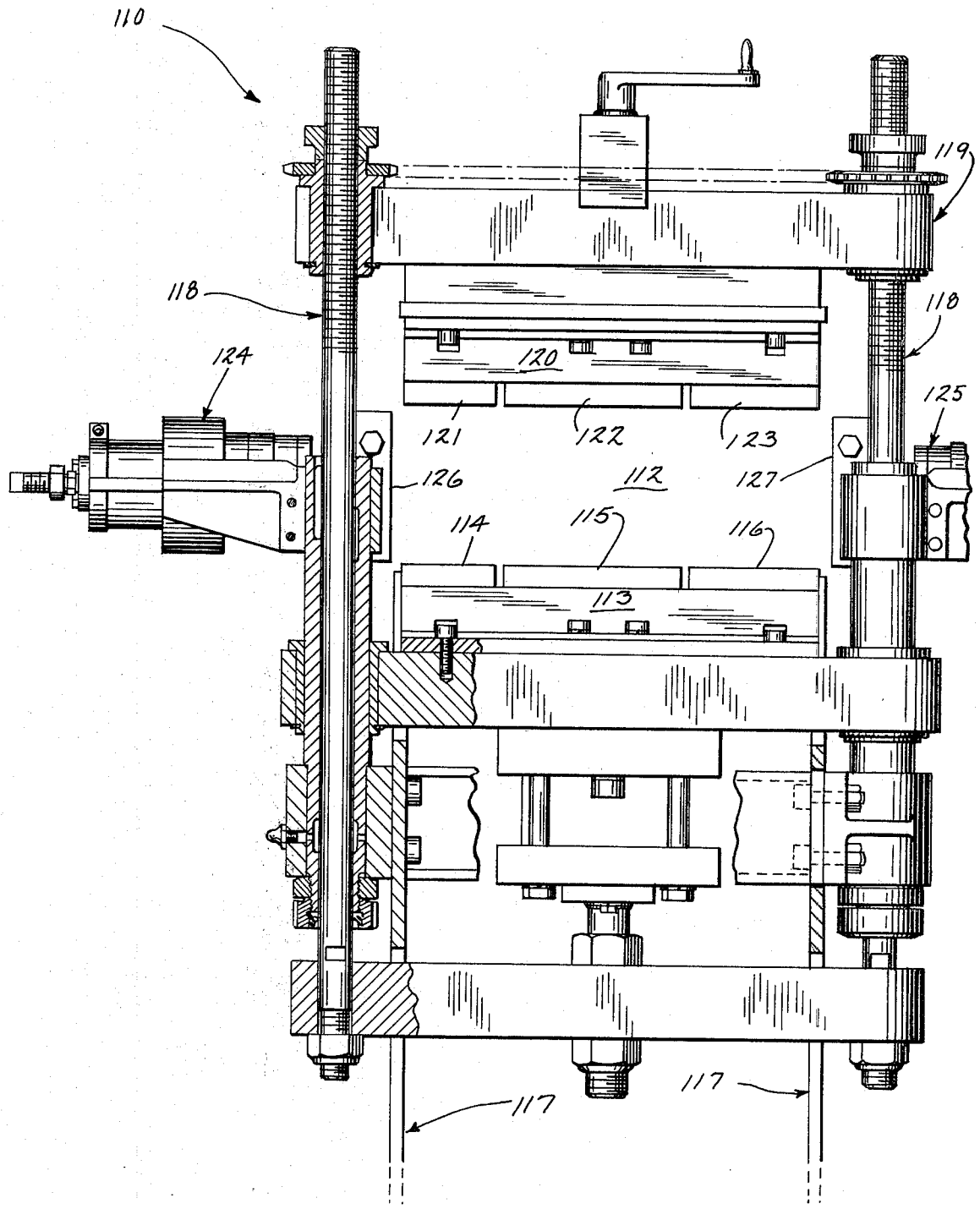
FIG. 8 is a front elevational view of the splitting apparatus of FIG. 7.
Figure 10:
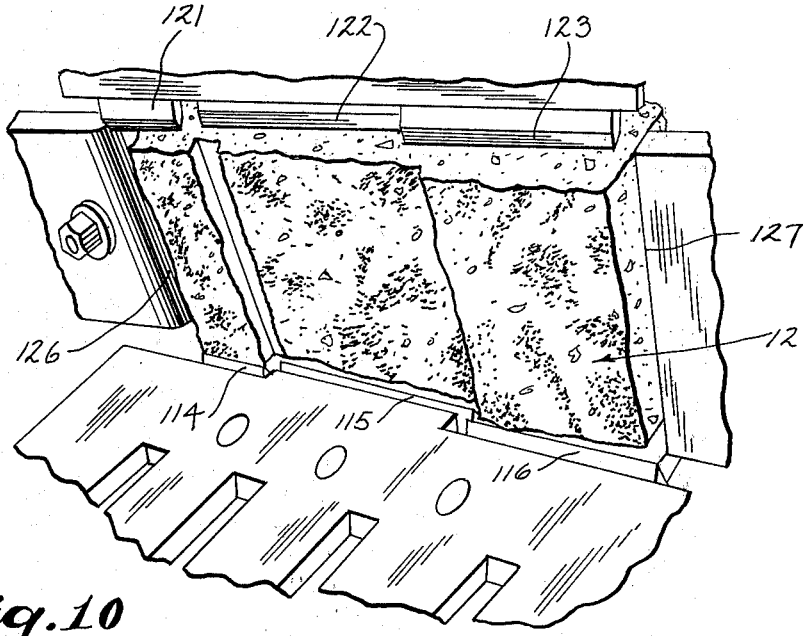
FIG. 10 is a perspective view of the splitting chamber of the splitting apparatus of FIG. 7 in relation to a split block.

After the prongs 81 and 82 of divider 80 are placed within the mold box 65, cement-like material such as concrete or the like is placed within the cavity 74 and permitted to harden to form a unitary composite 14. Either while the cement-like material is hardening or after it has hardened and cured, the division plate 80 and the retaining bars 76 and 78 and associated form members 75, 77 and 79 are removed thereby leaving a unitary composite 14 as illustrated in FIG. 3. The cement-like material may be placed into a kiln for steam curing for hardening the concrete.

The composite 14 includes a vertically extending notch 101 which has been formed by the ridge 92 and defines a separation between the sidewalls 15 and 42. Further, an oppositely spaced vertically extending notch 102 has been formed by ridge 99 and forms a separation between the sidewalls 16 and 43. A pair of openings 103 and 104 have been formed in the central portion of the composite 14 by the removal of the prongs 81 and 82, respectively. The opening 103 includes the oppositely spaced grooves 38 and 59 while the opening 104 includes the oppositely spaced grooves 36 and 61. A vertically extending notch 105 of opening 103 is formed by the ridge 91 and is aligned with notch 101 to be within a common plane 28, 51. The opening 103 further provides a vertically extending notch 106 which has been formed by ridge 93 and is aligned with a notch 107 of opening 104 to be within a common plane 33, 56. A vertically extending notch 108 of opening 104 is aligned with notch 102 to be within a common plane 31, 54.

Following the removal from the molding box 65, the composite 14 progresses along a conveyer 109 to a splitting apparatus 110. The splitter 110 may be selected from any one of a number of known commercial cement block splitting machines, such as marketed by Columbia Machine, Inc. of Vancouver, Wash., but modified to have plural cutting blades as more fully set forth hereafter. As the composite 14 reaches a predetermined point, limit switches or other sensing devices activate a series of arms 111 which operate to transfer composite 14 into a splitting chamber 112 provided by the splitting machine 110. The splitting machine 110 includes a base member 113 which retains a series of splitting blades as illustrated at 114, 115 and 116.

The base or bed 113 is supported by a series of supports 117 which, in turn, further support a series of upwardly directed threaded rods 118. An upper carriage 119 is mounted upon rods 118 and is selectively activated to move vertically. A plate assembly 120 is mounted on a lower portion of carriage 119 and includes three spaced splitting blades 121, 122 and 123 which are aligned with associated splitting blades 114, 115 and 116 mounted therebelow. In such manner, the pair of splitting blades 114 and 121 are mounted within the same splitting plane and are designed to be aligned with the module 14 along the splitting plane 28, 51. In like manner, the pair of splitting blades 115 and 122 are aligned within the same plane and are designed to be aligned with the splitting plane 33, 56 of module 14. The pair of blades 116 and 123 are likewise aligned within the same plane and are designed to be aligned with the splitting plane 31, 54 of the module 14.

A pair of spaced reciprocating pistons 124 and 125 are located on opposite sides of the chamber 112 and attached to one or more of the rods 118. The reciprocating piston 124 provides a splitting blade 126 which is adapted to be aligned with notch 101 of module 14 which corresponds to the plane 28, 51. The reciprocating piston 125 also includes a splitting blade 127 which is situated to be aligned with notch 102 of module 14 and therefore aligned with the plane 31, 54.

The splitting apparatus 110 senses the relative positioning of the module 14 within the chamber 112 such as through an appropriate sensor to operate the carriage 119 to vertically move the splitting blades 121, 122 and 123 in a downward direction to strike the top of module 14. Simultaneously, the pistons 124 and 125 are operated to move the splitting blades 126 and 127 horizontally toward the chamber 112 to strike the module 14 at oppositely spaced sides thereof and particularly along the notches 101 and 102, respectively. The operation of the series of knives 114–116, 121–123, 126 and 127 function to simultaneously split the module 14 along three different planes, i.e. plane 28, 51; plane 33, 56; and plane 31, 54. The splitting machine 110 thereby causes the module 14 to split into two blocks 12 and 13, with block 12 having a series of front facing areas 25, 26, 27 each having a different area and each spaced by a markedly different distance from the backwall 18, and block 13 having a series of front facing areas 48, 49 and 50 each having a different area and each spaced by a markedly different distance from the backwall 41. The openings 103 and 104 which provide the series of notches 105, 106, 107 and 108 together with the externally facing notches 101 and 102 assist in providing a controlled fracture of the composite 14 to provide the distinct and separable surface areas which substantially differ from adjacent areas. The splitting causes an irregular fracture to provide an extremely decorative rough appearance which is highly attractive particularly when placed in a wall formation.

After the composite 14 has been split into two separate block 12 and 13, the splitting machine 110 retracts the knives 121–123, 126 and 127 from the splitting chamber 112 and thereafter ejects the pair of blocks 12 and 13 by one or more reciprocating levers (not shown) to transfer the pair of blocks 12 and 13 along an exit conveyer 128 so that the blocks may be readily stacked for storage or shipment.

Figure 11:
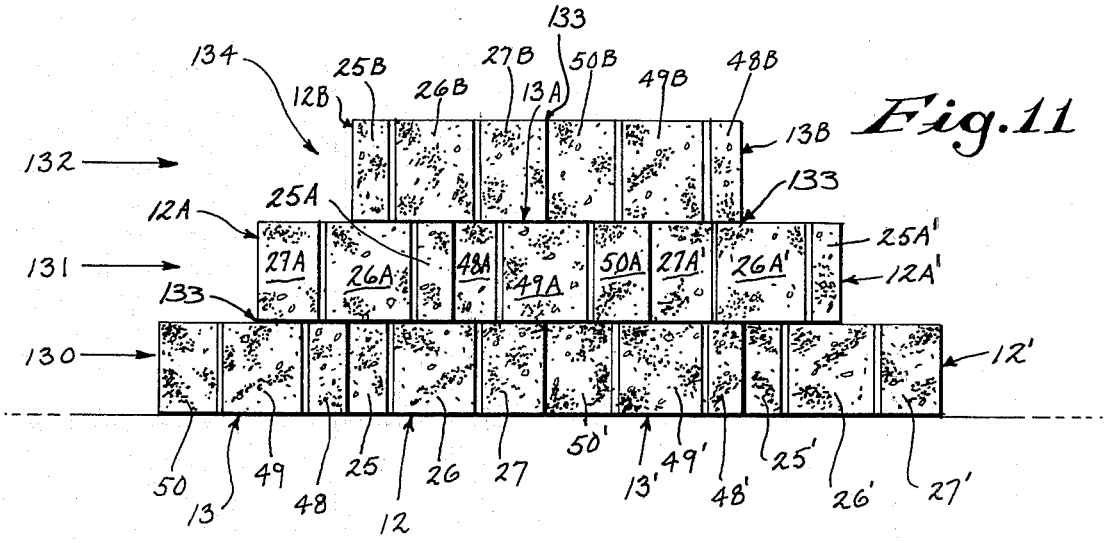
FIG. 11 is a front elevational view of a wall formed with a series of blocks of the type shown in FIGS. 1 and 2.
Figure 12:
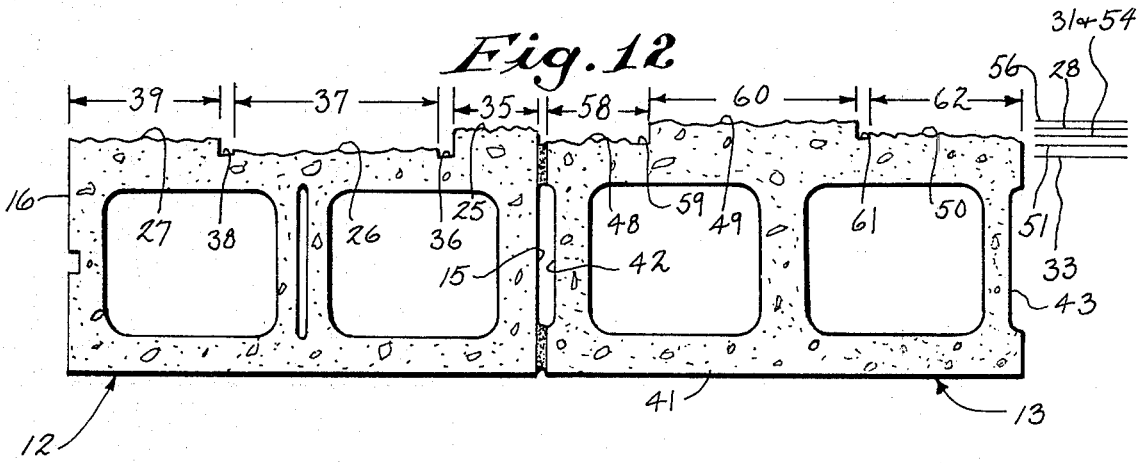
FIG. 12 is a plan view of a pair of adjacent blocks of the type shown in FIGS. 1 and 2.

A series of blocks 12 and 13 may be utilized to construct a masonry wall laid up in courses as illustrated at 130, 131 and 132 in FIG. 11. Each block is connected to adjacent blocks by conventional mortared joints 133. Duplicate blocks 12 and 13 in each course are identified by numbers primed and double-primed. Further, the blocks in courses 131 and 132 have been identified by the addition of letters A and B, respectively. The courses 130, 131 and 132 have been laid in a running bond so that a single block in upper courses will rest upon two lower blocks and the series of cores 20 and 45 will be aligned in a vertical column to form the wall 134, as illustrated in FIG. 11.

The wall 134 provides a distinct decorative appearance in that each decorative surface area in one course is spaced out of vertical alignment with an adjacent surface area in another immediately adjacent course. The wall 134 thus provides a plurality of surface areas of different depths for a random decorative appearance. Further, the surface areas in one course will have a different width than vertically spaced surface areas to provide a completely random pattern and appearance.

The method of constructing plural blocks each containing plural split decorative wall areas has been found to be extremely economical to provide high quality building-type blocks which provide a distinctive randomly orientated multiple split type appearance. Each block may be used in various orientations with other blocks mounted adjacently in each course or in adjacent courses to provide a usual decorative wall appearance.

Various modes of carrying out the invention are contemplated as being within the scope of the following claims particularly pointing out and distinctly claiming the subject matter which is regarded as the invention.

I claim:

1. In a primary masonry type block formed from concrete and providing a front surface and a back surface, said front surface including a first surface portion split generally along a first splitting plane spaced from a reference plane provided by said back wall surface by a first predetermined depth to provide a first distinct irregular split surface area and a second surface portion split generally along a second splitting plane spaced from said reference plane by a second predetermined depth substantially different than said first depth to provide a second distinct irregular split surface area distinguishable from said first surface area, said front surface providing said first and second distinct irregular split surface areas of distinguishable varying depths for a decorative appearance.

2. The primary masonry type block of claim 1, and including a third surface portion split generally along a third splitting plane spaced from said reference plane by a third predetermined depth substantially different than said second depth to provide a third distinct irregular split surface area distinguishable from said second surface area, said second split surface area being sandwiched between said first and third split surface areas to provide at least three distinct irregular split surface areas each varying in depth with respect to an immediately adjacent split surface area.

3. In a primary masonry type block formed from concrete and providing spaced front and back surfaces, said front surface including a first surface portion aplit generally along a first plane to provide a first distinct irregular split surface area of a first predetermined width and a second surface portion split generally along a second plane spaced from said first plane to provide a second distinct irregular split surface area of a second predetermined width substantially different than said first width, said front surface providing said first and second distinct irregular split surface areas of varying widths for a decorative appearance.

4. The primary masonry block of claim 3, and including a third surface portion split generally along a third plane spaced from said second plane to provide a third distinct irregular split surface area of a third predetermined width substantially different than said second width, said second split surface area being sandwiched between said first and third split surface areas to provide at least three distinct irregular split surface areas each varying in width with respect to an immediately adjacent split surface area.

5. In a primary masonry type block formed from concrete and providing a front wall surface spaced from a back wall surface, said front wall surface including a first surface including a first portion split generally along a first splitting plane spaced from a reference plane provided by said back surface by a first predetermined depth to provide a first distinct irregular split surface area of a first predetermined width and a second surface including a second portion split generally along a second splitting plane spaced from said reference plane by a second predetermined depth different than said first depth to provide a second distinct irregular split surface area of a second predetermined width different than said first width and a third surface including a third portion split generally along a third splitting plane spaced from said reference plane by a third predetermined depth different than said first and second depths to provide a third distinct irregular split surface area of a third predetermined width different than said first and second widths, said front surface providing said first, second and third distinct irregular split surface areas of varying depths and widths to provide a decorative appearance.

6. In a masonry wall constructed of a plurality of blocks laid up in courses with mortared joints therebetween, wherein each of said blocks provides a back surface and an oppositely spaced front surface including a first surface portion split generally along a first splitting plane spaced by a first predetermined depth from a reference plane provided by said back surface to provide a first distinct irregular split surface area and a second surface portion split generally along a second splitting plane spaced by a second predetermined depth different than said first depth from said reference plane to provide a second distinct irregular split surface area distinguishable from said first surface area, with said first and second surface areas in one course spaced out of vertical alignment with said first and second surface areas in another immediately adjacent course to provide said wall having a plurality of adjacent surface areas of randomly different depths for a decorative appearance.

7. The masonry wall of claim 6, wherein said front surface includes a third surface portion split generally along a third splitting plane spaced from said reference plane by a third predetermined depth substantially different than said second depth to provide a third distinct irregular split surface area distinguishable from said second surface area, said first, second and third surface areas in one course spaced out of vertical alignment with said first, second and third surface areas in another immediately adjacent course to provide said wall having a plurality of adjacent surface areas of randomly different depths for a decorative appearance.

8. In a masonry wall constructed of a plurality of blocks laid up in courses with mortared joints therebetween, wherein each of said blocks provides a front surface including a first surface portion split generally along a first plane to provide a first distinct irregular split surface area of a first predetermined width and a second surface portion split generally along a second plane spaced from said first plane to provide a second distinct irregular split surface area having a second predetermined width different than said first width, said first and second surface areas in one course spaced out of vertical alignment with said first and second surface areas in another immediately adjacent course to provide said wall having a plurality of adjacent surface areas of randomly different widths for a decorative appearance.

9. The masonry wall of claim 8, wherein said front surface includes a third surface portion split generally along a third plane spaced from said second plane to provide a third distinct irregular split surface area of a third predetermined width different than said second width, said first, second and third surface areas in one course spaced out of vertical alignment with said first, second and third surface areas in another immediately adjacent course to provide said wall having a plurality of adjacent surface areas of randomly different widths for a decorative appearance.

10. In a masonry wall constructed of a plurality of first and second blocks formed from a single molded construction and laid up in courses with mortared joints therebetween wherein each of said first and second blocks comprises front and back walls joined by a plurality of spaced transverse webs to define at least one integral void between adjacent webs with the voids in each course being substantially vertically aligned in stacks with voids of other courses, said first block providing a front wall surface spaced from a back wall surface and having a first surface portion split generally along a first splitting plane spaced from said back surface by a first predetermined depth to provide a first split surface area of a first predetermined width and a second surface portion adjacent to said first portion and split generally along a second splitting plane spaced from said back surface by a second predetermined depth different than said first depth to provide a second split surface area of a second predetermined width different than said first width and a third surface portion adjacent to said second portion and split generally along a third splitting plane spaced from said back surface by a third predetermined depth different than said first and second depths to provide a third split surface area of a third predetermined width different than said first and second widths, said second block providing a front wall surface spaced from a back wall surface and having a fourth surface portion split generally along a fourth splitting plane spaced from said back surface by a fourth predetermined depth to provide a fourth split surface area of a fourth predetermined width and a fifth surface portion adjacent to said fourth portion and split generally along a fifth splitting plane spaced from said back surface by a fifth predetermined depth different than said fourth depth to provide a fifth split surface area of a fifth predetermined width different than said fourth width and a sixth surface portion adjacent to said fifth portion and split generally along a sixth splitting plane spaced from said back surface by a sixth predetermined depth different than said fourth and fifth depths to provide a sixth split surface area of a sixth predetermined width different than said fourth and fifth widths, with said first through sixth portions in one course spaced out of vertical alignment with said first through sixth portions in another immediately adjacent course to provide said wall having a plurality of vertically spaced adjacent surface portions of randomly different widths and depths for a decorative appearance.

11. A method of constructing a building wall comprising the steps of providing a series of split first and second rectangular blocks of cement-like material with said first block providing first and second distinct irregular split surface areas of first and second different depths, respectively, and said second block providing third and fourth distinct irregular split surface areas of third and fourth different depths, respectively, laying the blocks abutting endwise in courses upon joint motar applied to the top edges of the blocks in underlying courses and placing the first through fourth surface areas in one course out of spaced vertical alignment with said first through fourth surface areas in another immediately adjacent course to provide a wall having a plurality of surface areas of randomly different depths for a decorative appearance.

12. A method of constructing a building wall comprising the steps of providing a series of split first and second rectangular blocks of cement-like material with said first block providing first and second distinct irregular split surface areas of first and second different widths and depths, respectively, and said second block providing third and fourth distinct irregular split surface areas of third and fourth different widths and depths, respectively, laying the blocks abutting endwise in courses upon joint motar applied to the top edges of the blocks in underlying courses and placing the first through fourth surface areas in one course out of spaced vertical alignment with said first through fourth surface areas in another immediately adjacent course to provide a wall having a plurality of surface areas of randomly different widths for a decorative appearance.

13. A method of constructing a building wall comprising the steps of providing a series of split first and second rectangular blocks of cement-like material with said first block providing first, second and third distinct irregular split surface areas of first, second and third different depths, respectively, and first, second and third different widths, respectively, and said second block providing fourth, fifth and sixth distinct irregular split surface areas of fourth, fifth and sixth different depths, respectively, and fourth, fifth and sixth different widths, respectively, and laying the blocks abutting endwise in courses upon bed joint motar applied to the top edges of the blocks in underlying courses by placing said first through sixth surface areas in one course out of spaced vertical alignment with said first through sixth surface areas in another immediately adjacent course to provide said wall having a plurality of adjacent surface areas of randomly different widths and depths for a decorative appearance.

* * * * *

UNITED STATES PATENT AND TRADEMARK OFFICE

CERTIFICATE OF CORRECTION

PATENT NO. : 4,335,549

DATED : June 22, 1982

INVENTOR(S) : Robert W. Dean

It is certified that error appears in the above-identified patent and that said Letters Patent is hereby corrected as shown below:

Column 8, line 43, "a usual" should read -- an unusual --

Column 9, line 9, "aplit" should read -- split --.

Column 11, line 41 "motar" should read -- mortar --

Column 12, line 15 "motar" should read -- mortar --

Column 12, line 36, "motar" should read -- mortar --

Signed and Sealed this

Seventh Day of December 1982

[SEAL]

*Attest:*

GERALD J. MOSSINGHOFF

*Attesting Officer*

*Commissioner of Patents and Trademarks*